US007513383B2

(12) United States Patent
Hwang

(10) Patent No.: US 7,513,383 B2
(45) Date of Patent: Apr. 7, 2009

(54) OPENING DEVICE FOR CAN

(76) Inventor: Bo-Yeoun Hwang, 102-1502 Hyundae Apartment, Banlim-Dong, Changwon City, Gyeongnam, 641-767 (KR)

( * ) Notice: Subject to any disclaimer, the term of this patent is extended or adjusted under 35 U.S.C. 154(b) by 0 days.

(21) Appl. No.: 10/478,640

(22) PCT Filed: Nov. 27, 2002

(86) PCT No.: PCT/KR02/02220

§ 371 (c)(1),
(2), (4) Date: Nov. 25, 2003

(87) PCT Pub. No.: WO2004/035399

PCT Pub. Date: Apr. 29, 2004

(65) Prior Publication Data

US 2005/0173437 A1 Aug. 11, 2005

(30) Foreign Application Priority Data

Oct. 18, 2002 (KR) ..... 10-2002-0063872

(51) Int. Cl.
*B65D 17/34* (2006.01)

(52) U.S. Cl. ..... 220/269; 220/906

(58) Field of Classification Search ..... 220/271, 220/906, 269

See application file for complete search history.

(56) References Cited

U.S. PATENT DOCUMENTS 2,761,583 A * 9/1956 Morse ..... 220/271
2,974,824 A * 3/1961 Mansho ..... 220/271
3,307,737 A * 3/1967 Harvey et al. ..... 220/271
3,313,446 A * 4/1967 Harvey ..... 220/271
3,434,622 A * 3/1969 Czegledy ..... 220/231
3,441,167 A * 4/1969 Balocca ..... 220/271
3,662,914 A * 5/1972 Slade ..... 220/271
3,826,401 A * 7/1974 Zundel ..... 220/277
3,967,750 A * 7/1976 Cudzik ..... 220/266
3,970,212 A * 7/1976 Brown ..... 220/269
4,030,631 A * 6/1977 Brown ..... 220/269

(Continued)

FOREIGN PATENT DOCUMENTS

JP 09-301364 11/1997

*Primary Examiner*—Anthony D. Stashick
*Assistant Examiner*—James N Smalley
(74) *Attorney, Agent, or Firm*—Lahive & Cockfield, LLP

(57) ABSTRACT

The present invention relates to an opening device for a can, which is constructed such that the contents of the can flow out and exterior air is simultaneously introduced into the can. The opening device of the present invention comprises first and second opening portions 122 and 124 through which the contents flow out and the exterior air is introduced into the can upon opening thereof, respectively, and which are disposed to be opposite to each other at both sides of the top surface 110 of the can and defined by incision lines 122*a* and 124*a* so that a part of each of the opening portions is attached to the top surface; and a tab 140 mounted on the top surface of the can by means of a first rivet stub Ra installed outside of the first opening portion and a second rivet stub Rb installed within the second opening portion. The second opening portion is opened while being lifted together with the second rivet stub Rb, the first opening portion is opened while being pressed by a pressing portion 144 around the first rivet stub, and the second rivet stub is formed to be closer to a grip 172 of the tab 170 than the first rivet stub.

4 Claims, 6 Drawing Sheets

U.S. PATENT DOCUMENTS 4,094,435 A * 6/1978 Kennedy ..... 220/269
4,572,398 A * 2/1986 Juty ..... 220/271
4,576,306 A * 3/1986 Kelsey et al. ..... 220/271
4,705,186 A * 11/1987 Barrash ..... 220/269
5,190,149 A * 3/1993 Krause ..... 220/269
5,397,014 A * 3/1995 Aydt ..... 220/269
5,555,992 A * 9/1996 Sedgeley ..... 220/269
5,695,085 A * 12/1997 Hadener ..... 220/269
5,819,973 A * 10/1998 Traub et al. ..... 220/271
2002/0139800 A1 10/2002 Hwang et al.
2003/0098306 A1 * 5/2003 Cho ..... 220/269
2003/0189045 A1 * 10/2003 Hwang ..... 220/269

* cited by examiner

Prior Art

Prior Art

Prior Art

Prior Art

OPENING DEVICE FOR CAN

This Application claims priority under 35 U.S.C. § 365 to International Application PCT/KR02/02220 filed Nov. 27, 2002, which claims priority to Korean Application KR 2002-63872, filed Oct. 18, 2002.

TECHNICAL FIELD

The present invention relates to an opening device for a beverage can, and more particularly, to an opening device for a can, which is constructed such that beverage contained within the can is able to flow out more easily.

BACKGROUND ART

FIG. 1 is a perspective view of an opening portion of a conventional can. As shown in the figure, contents such as beverage or beer to be drunk are generally contained within a can body 10, and an opening device for opening the can is generally attached to a top surface 12 or bottom surface of the can body. An opening member 20 attached to the top surface 12 through a rivet stub 24 is used to open a predetermined portion of the top surface of the can body 10. Further, the opening member 20 comprises a grip 22 extending to one side with respect to the rivet stub 24, and a pressing portion 26 extending to the opposite side with respect to the rivet stub 24.

An opening portion 29 defined by an incision line 28 grooved with a predetermined depth is formed on a portion of the top surface 12 below the pressing portion 26.

Here, when a user pulls up the grip 22, the pressing portion 26 of the opening member 20 opposite to the grip 22 is moved downward around the rivet stub 24. When the pressing portion 26 is moved downward, a downward force is applied to the opening portion 29, and the opening portion 29 is then substantially separated from the top surface 12 along the incision line 28 for defining the opening portion 29. With this action, the opening portion 29 is substantially opened so that the beverage of the can body 10 may flow out.

A portion of the opening portion 29 defined by the incision line 28 is still attached to the top surface 12 of the can body. Thus, it is also known in the art that when the can is opened as the opening portion 29 is moved downward by the pressing portion 26, the portion of the opening portion 29 is constructed to be still attached to the top surface 12 of the can.

However, there are the following problems in the prior art. That is, when the beverage flows out from the interior of the can body 10, exterior air should be introduced to the interior of the can body 10 to the contrary so that the beverage may smoothly flow out. However, in the constitution of the can according to the prior art, since only one opening portion 29 is formed, there is a disadvantage in that the contents cannot smoothly flow out in a process of introduction of the exterior air and simultaneous outflow of the beverage. Accordingly, in an initial stage until a predetermined amount of beverage substantially flows out from the can (i.e., until the exterior air is introduced through an upper part of a hole corresponding to the opening portion while the beverage flows out through a lower part of the hole by tilting the can at a certain angle), it is very difficult to drain the beverage.

Next, a type of opening device for the conventional can will be described with reference to FIGS. 3 and 4. The type of opening device shown in FIG. 3 is a so-called ring-pull-tab type, wherein when a grip 62 of a tab 60 installed on a top surface U of the can is pulled up, an opening portion 64 is lifted together with a rivet stub. That is, the opening portion 64 is opened while being lifted as the tab 60 moves upward. In this case, the opening portion 64 defined by an incision line 64*a* is completely separated, together with the tab 60, from the top surface U of the can. In such a type, it can be seen that the rivet stub 66 is installed substantially within the opening portion 64.

Such a ring-pull-tab type opening device has an advantage in that an opening force applied by a user is smaller, but has a disadvantage in that it is environmentally undesirable since both the tab 60 and the opening portion 64 are separated from the top surface U of the can.

FIG. 4 shows a so-called stay-on-tab type opening device. In such an opening device, when a grip 72 of a tab 70 installed on a top surface U of a can is pulled up, a pressing portion 76 moves downward around a rivet stub 74 and presses an opening portion 78 therebelow. Therefore, the opening portion 78 is urged downward and then spaced apart from the top surface U so that the opening portion 78 may be substantially opened. In such a stay-on-tab type opening device, it can be seen that the rivet stub 74 is installed on a portion of the top surface U outside of the opening portion 78.

In this opening device, the entire opening portion 78 is not opened but a portion of the opening portion 78 is still attached to the top surface U of the can. Therefore, such an opening device is advantageous to environmental protection since the opening portion 78 is not separated from the top surface U of the can, but has a disadvantage in that a force required for lifting the tab 70 through the grip 72 is larger than that of the ring-pull-tab type opening device.

In order to overcome these disadvantages of the opening devices for the cans each of which has a single opening portion, an opening device for a can shown in FIG. 2 has been proposed in Korean Utility Model Laid-Open Publication No. 98-55776 and Japanese Utility Model Laid-Open Publication No. (Sho) 55-69029. This opening device will be described in brief with reference to FIG. 2.

As shown in the figure, the conventional opening device for a can comprises a pair of opening portions 32 and 34 formed on a top surface of the can. The opening portions 32 and 34 are defined by incision lines where the top surface of the can is processed to be relatively thin in thickness when they are manufactured by a metallic pattern. Such opening portions 32 and 34 are composed of a first opening portion 32 through which contents of the can are able to substantially flow out to the outside upon opening thereof, and a second opening portion 34 through which exterior air is able to be introduced into the can upon opening thereof.

The opening device includes a grip 30 which a user can catch with his/her finger(s), and a pair of pressing portions 36*a* and 36*b* formed at both ends of the grip for pressing and opening the opening portions 32 and 34, respectively. Here, when the user pulls up the grip 30, the pressing portions 36*a* and 36*b* press the opening portions 32 and 34 downward around lever fulcrums Ha and Hb, respectively. The opening portions 32 and 34 are then spaced apart downward from the top surface of the can so that the contents may flow out.

According to the conventional opening device constructed as such, the contents may more easily flow out to the outside by forming substantially two opening portions. Further, in a case where the opening portions are formed into a pair, the two opening portions should be opened when the grip 30 is pulled up. Therefore, the opening portions should be more easily opened by means of a force with which a user pulls up the grip.

However, according to the conventional opening device shown in the figure, it is not easy to substantially simultaneously open the two opening portions. That is, since the grip should be pulled up with a force larger than that required for a conventional opening device for opening a single opening portion, there is naturally inconvenience of use. Further, since sufficient strength resistant to such a larger force should be ensured between the grip and the pressing portions, there is a disadvantage in that there are limitations on the design thereof in view of strength.

DISCLOSURE OF THE INVENTION

An object of the present invention is to provide an opening device for a can constructed such that contents of the can are able to flow out very smoothly to the outside.

Another object of the present invention is to provide an opening device for a can constructed such that two opening portions can be opened even with the possibly smallest force.

An opening device for a can according to the present invention for achieving the above objects is formed on a top surface of a cylindrical can with contents contained therein, and comprises first and second opening portions through which the contents flow out and the exterior air is introduced into the can upon opening thereof, respectively, and which are disposed to be opposite to each other at both sides of the top surface of the can and defined by incision lines so that a part of each of the opening portions is attached to the top surface; and a tab mounted on the top surface of the can by means of a first rivet stub installed outside of the first opening portion and a second rivet stub installed within the second opening portion. The second opening portion is opened while being lifted together with the second rivet stub, the first opening portion is opened while being pressed by a pressing portion around the first rivet stub, and the second rivet stub is formed to be closer to a grip of the tab than the first rivet stub.

According to the present invention, the second opening portion is opened while being lifted together with the tab, and the first opening portion is opened while being pressed downward. Therefore, it is expected to obtain an advantage in that the pair of opening portions may be more easily opened as a whole.

BEST MODE FOR CARRYING OUT THE INVENTION

Hereinafter, the present invention will be described in detail in connection with preferred embodiments illustrated in the accompanying drawings.

Figure 1:
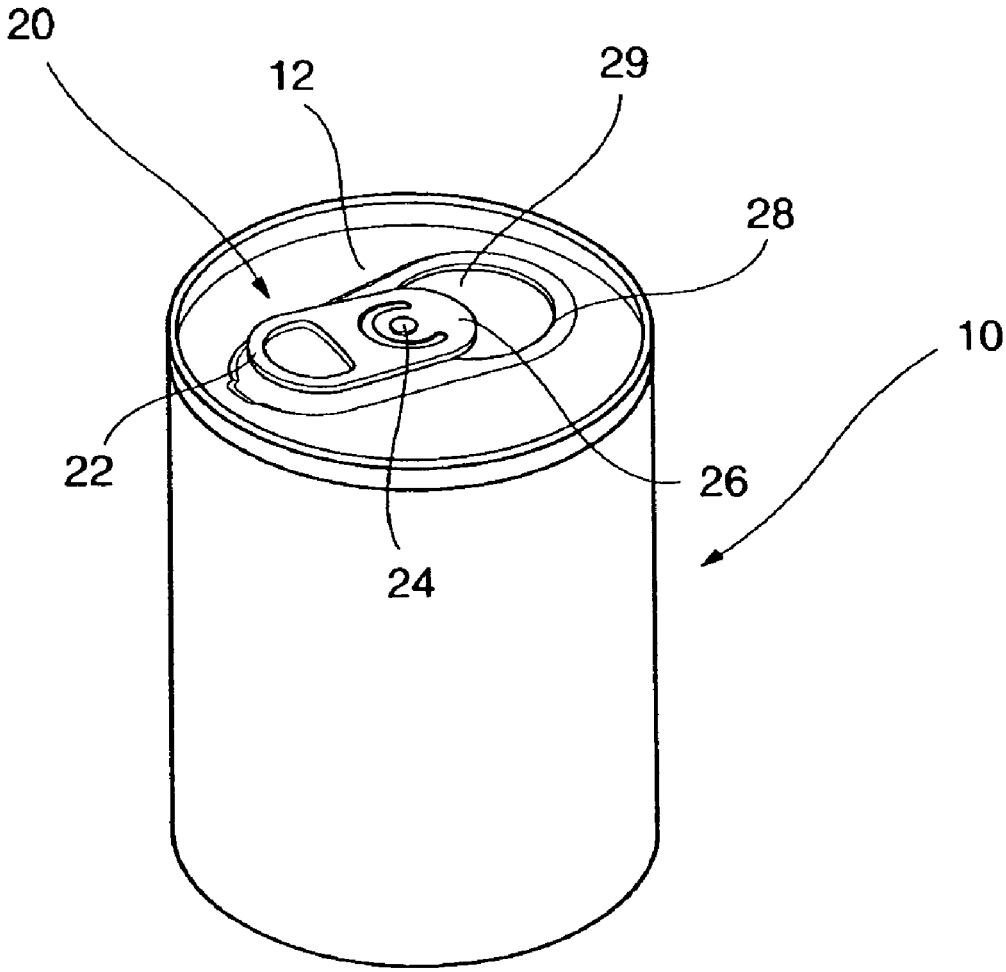
FIG. 1 is an exemplary view of a conventional opening device for a can.
Figure 2:
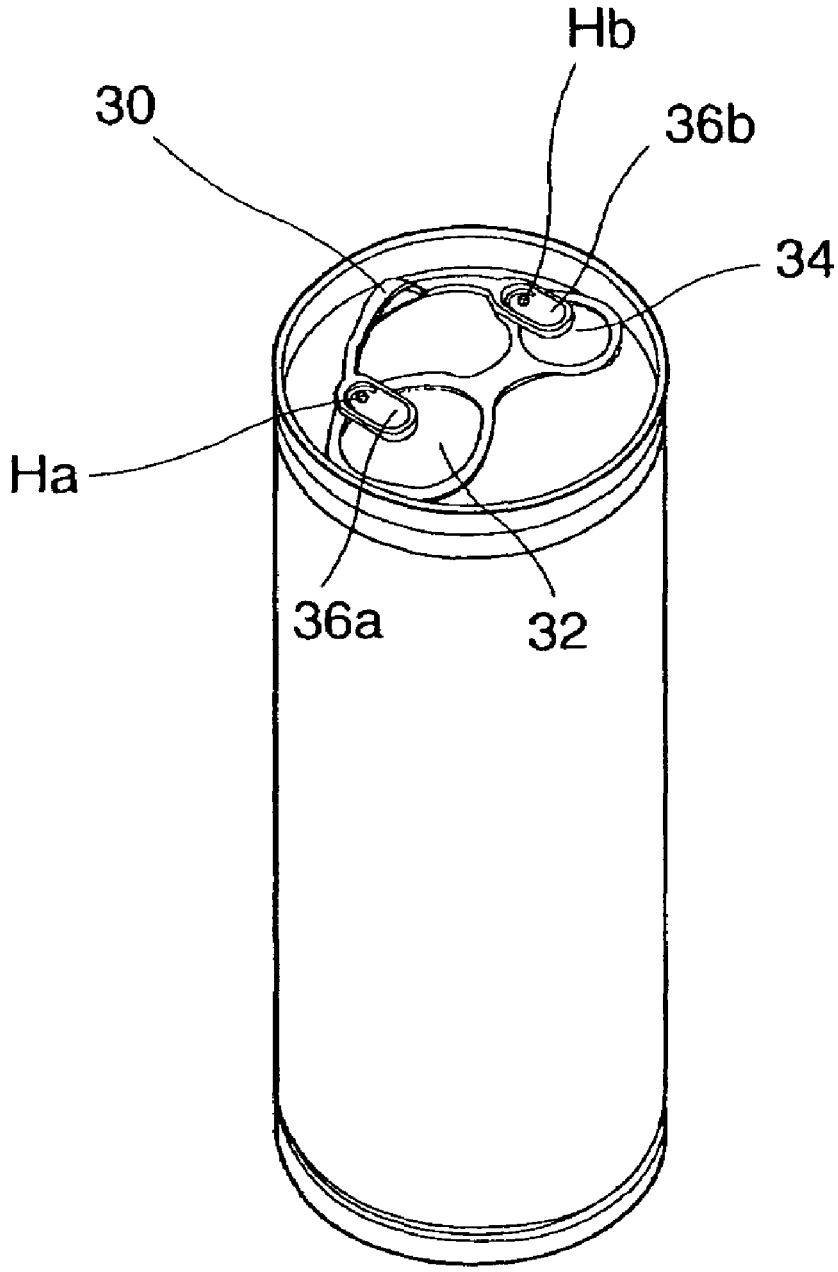
FIG. 2 is an exemplary view of another conventional opening device for a can.
Figure 3:
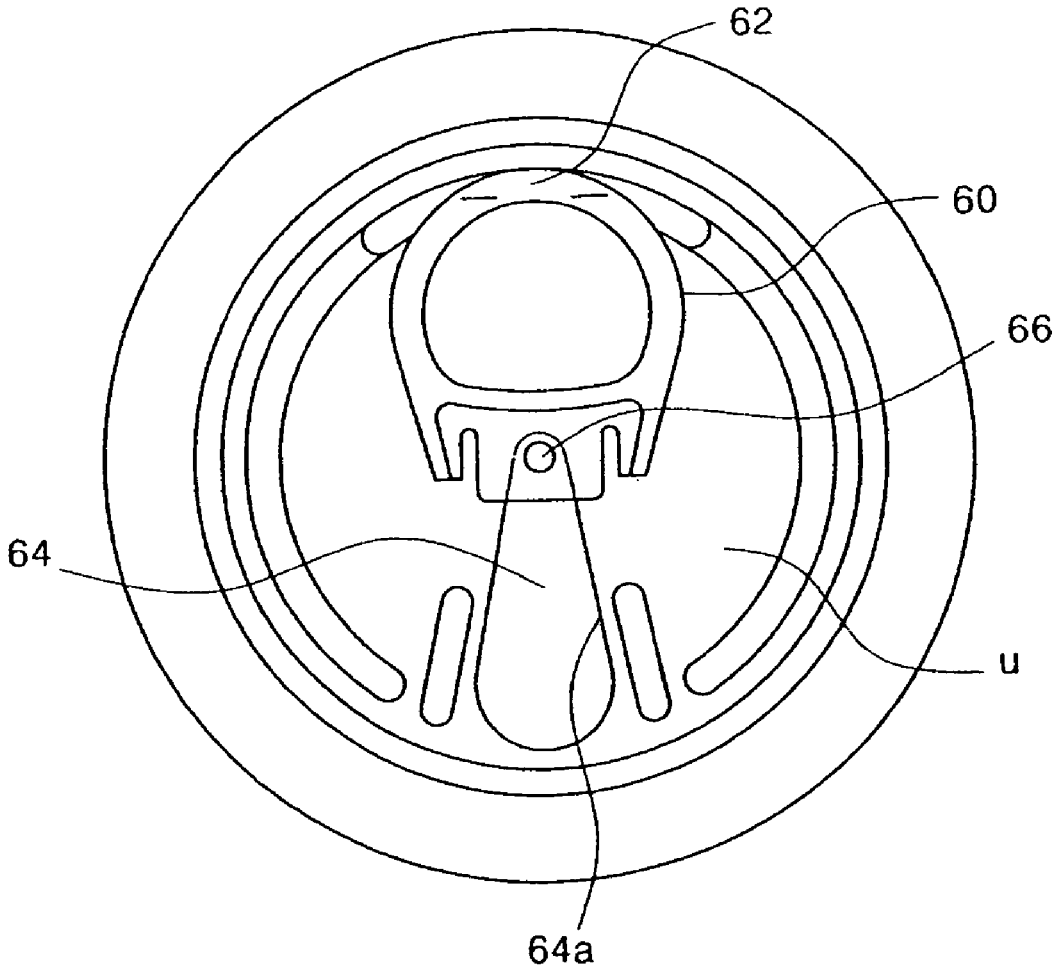
FIG. 3 is a plan view explaining the opening operation of a conventional opening device for a can.
Figure 4:
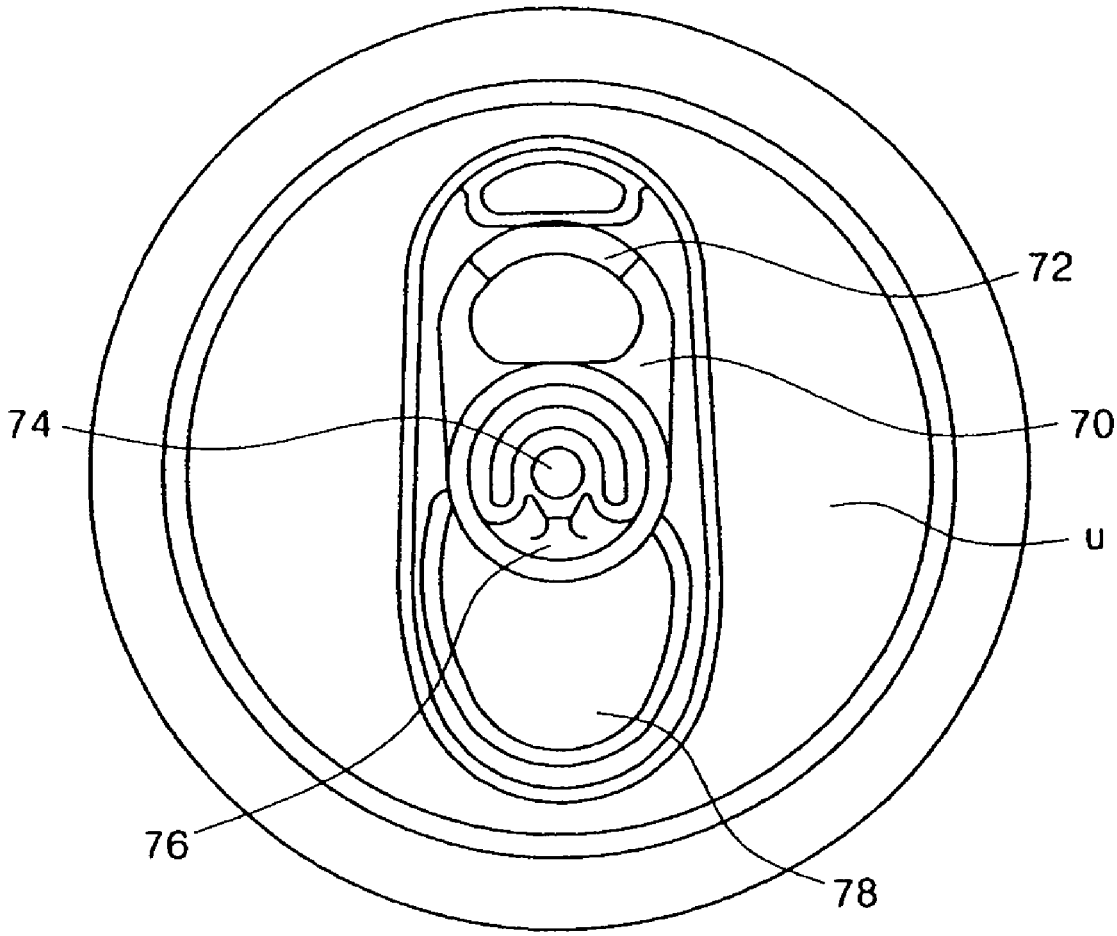
FIG. 4 is a plan view explaining the opening operation of another conventional opening device for a can.

FIG. 3 shows a plan view of a can with an opening device according to a first embodiment of the present invention.

As shown in the figure, the opening device of the present invention includes a pair of opening portions 122 and 124 formed on a top surface 110 of the can 100. The opening portions 122 and 124 include a first opening portion 122 through which the contents of the can flow out upon opening thereof, and a second opening portion 124 through which exterior air is introduced into the can upon opening thereof while the contents of the can flows out through the second opening portion 122. As shown in the figure, the first opening portion 122 is formed to be relatively larger than the second opening portion 124. Further, the first and second opening portions 122 and 124 are formed at symmetrical positions of the top surface of the can, which is substantially circular. Therefore, if the can is tilted at a certain angle, the contents flow out through the first opening portion 122, while the exterior air is introduced into the can through the second opening portion positioned above the first opening portion 122 (in the state where the can is tilted).

For reference, in a can for containing beverage, predetermined amounts of contents and air are contained in the can. Therefore, if the can is tilted at a certain angle, the air contained in the can moves to an upper portion of the can (in the state where the can is tilted). Thus, since the air occupies the upper portion of the interior of the can at a position where the second opening portion 124 is substantially located, the exterior air is introduced into the can.

Further, the first and second opening portions 122 and 124 are defined by incision lines 122*a* and 124*a* formed on the top surface 110 of the can. However, the incision lines 122*a* and 124*a* are not formed throughout circular perimeter portions of the opening portions so that they are not formed at some parts of the circular perimeter portions. This configuration is to cause the parts of the opening portions 122 and 124 to be attached to the top surface 110 of the can when the opening portions 122 and 124 are separated and opened from the top surface 110 of the can, in consideration of environment.

Further, a tab 140 for opening the opening portions 122 and 124 is installed on the top surface 110 of the can 100. The tab 140 is to sequentially open the two opening portions 122 and 124 and is attached to the top surface 110 by means of a pair of rivet stubs Ra and Rb. Moreover, the rivet stubs Ra and Rb are portions enabling the opening portions 122 and 124 to be opened by the tab 140, and are generally formed integrally with the top surface 110.

The tab 140 is provided with a grip 142 which a user grasps and pulls. The grip 142 is a portion grasped and pulled up by the user, and a recess 122 is formed at a portion of the top surface 110 of the can, which is below the grip 142. It will be apparent that the recess 112 allows the user to more easily grasp and pull the grip 142 with his/her finger(s).

The first rivet stub Ra of the tab 140 enables the first opening portion 122 to be opened, and the second rivet stub Rb enables the second opening portion 124 to be opened. First, a configuration for opening the first opening portion 122 will be described.

A pressing portion 144 is formed to protrude below the first rivet stub Ra (when viewed in the figure). The pressing portion 144 is installed to be at a position above the first opening portion 122. Therefore, when the user pulls up the grip 142 of the tab 140, the pressing portion 144 moves substantially downward around the first rivet stub Ra as a level fulcrum. The pressing portion 144 that moves downward in such a manner presses down the first opening portion 122 so that the first opening portion 122 may be substantially opened. Here, it can be seen that the first rivet stub Ra is formed in a portion of the top surface 110 which is outside of the first opening portion 122.

The second rivet stub Rb is installed within the second opening portion 124. Further, the second rivet stub Rb is formed close to the grip 142 of the tab 140. When the grip 142 is pulled, the second rivet stub Rb lifts the second opening portion 124 so that the second opening portion 124 may be opened.

A configuration around the second opening portion 124 will be described in detail. An incision line 124*a* is not formed at a part of the perimeter of the second opening portion 124 so that the part may substantially define a connection 124*b* to the top surface 110. Thus, when the second opening portion 124 is opened, other parts of the second opening portion except for the connection 124*b* are separated from the top surface 110.

The connection 124*b* is formed on a side opposite to the grip 142. It can be seen that in order to cause the second rivet stub Rb to be positioned within the second opening portion 124, a second opening end 146 of the tab 140 is formed to substantially cover the second opening portion 124.

Here, it can be understood that the principles of the opening of the first and second opening portions 122 and 124 are different from each other. That is, as the grip 142 is pulled up, the second opening portion 124 is opened while being lifted together with the grip 142. Thus, it can be considered that the opening principle is similar to that of the aforementioned ring-pull-tab type opening device. However, since the incision line 124*a* is not formed at a part of the perimeter of the second opening portion 124, the entire second opening portion 124 is not separated from the top surface 110. Further, it can be understood that the incision line 124*a* defining the second opening portion 124 is formed such that the second opening portion 124 may be opened downward when viewed in the figure (in practice, in a direction from the periphery of the can to the center thereof).

On the contrary, the first opening portion may be considered as the stay-on-tab type described above. That is, the first opening portion 122 is opened in such a manner that the pressing portion 144 of the tab 140 presses the first opening portion. At this time, the incomplete separation of the first opening portion 122 from the top surface 110 is the same as the aforementioned conventional opening devices.

It can also be seen from the embodiment shown in the figure that the tab 140 for opening the opening portions 122 and 124 is "]"-shaped as a whole. This is to ensure that possibly linear forces are exerted on the opening portions 122 and 124 through the rivet stubs Ra and Rb to open them when the grip 142 is pulled. This is because forces required for opening the opening portions may be minimized when the forces are exerted on the opening portions 122 and 124 through the rivet stubs Ra and Rb as linearly as possible. Lines L1 and L2 in the figure mean directions in which a force for pulling up the grip 142 act on the respective rivet stubs Ra and Rb and opening portions 122 and 124. It can be understood that the force exerted on the tab 140 is caused to linearly act on the rivet stubs Ra and Rb and the opening portions 122 and 124 in such a manner, so that the two opening portions 122 and 124 may be opened with a substantially smallest force.

Next, sequential processes of opening the can in this embodiment will be described. When a user pulls up the grip 142 of the tab 140, an outer peripheral portion of the tab 140 corresponding to the grip 142 begins to be spaced apart from the top surface 110.

When the grip 142 of the tab 140 is lifted, a force is first exerted on the second rivet stub Rb close to the grip 142. When the force is exerted on the second rivet stub Rb, the second opening portion 124 is first opened. The second opening portion 124 is opened in the same manner as the so-called ring-pull-tab type opening device as described above, since the second rivet stub Rb is installed within the second opening portion 124. That is, the second opening portion 124 is opened while being lifted together with the rivet stub Rb.

When the opening of the second opening portion 124 is completed while the grip 142 of the tab 140 is lifted, the second opening portion 124 is inclined at a certain angle (in the same manner as the tab 140) in a state where the connection 124*b* of the second opening portion 124 is connected to the top surface 110.

Figure 5:
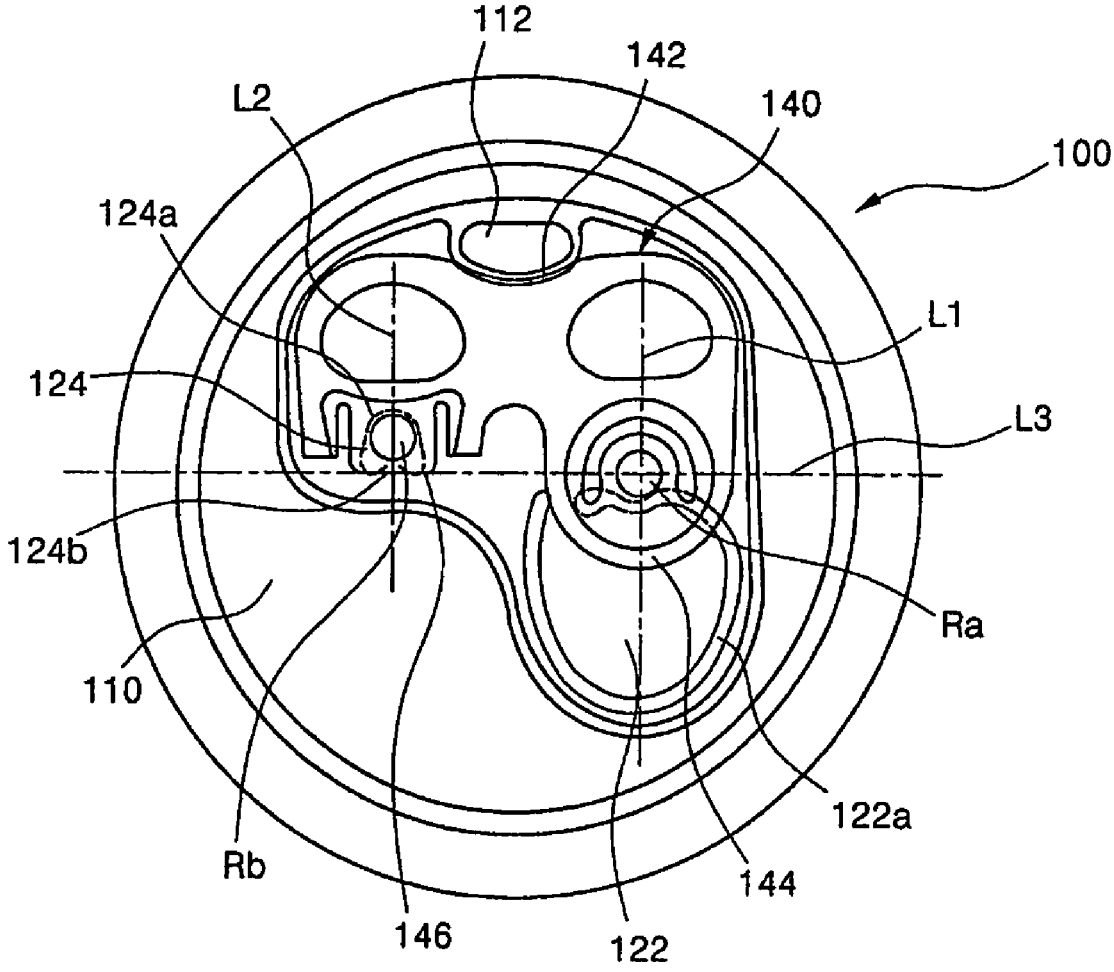
FIG. 5 is a plan view of a can according to the present invention.

In such a state, the first rivet stub Ra begins to be subjected to a force. It can be seen from a line L3 in FIG. 5 that the connection 124*b* and the second opening end 146 are formed at the almost same position and they are also located at the position at the same level as the first rivet stub Ra.

Therefore, when the second opening portion 124 is fully opened, the first rivet stub Ra begins to be subjected to the force. When the first rivet stub Ra is subjected to the force, the pressing portion 144 presses the first opening portion 122, so that the second opening portion 122 may be fully opened at last. It will be apparent that the second opening portion 122 is opened in the same manner as the aforementioned stay-on-tab type opening device and a part of the second opening portion 122 is still attached to the top surface 110.

The state where the first rivet stub Ra begins to be subjected to the force so that the first opening portion 122 may be opened will be discussed. In this state, the tab 140 is substantially inclined at a certain angle while the second opening end 146 at the same position as the connection 124*b* of the second opening portion 124 comes into contact with and is then supported by the top surface 110. Therefore, in a state where the tab 140 is about to open the first opening portion 122 by using the first rivet stub Ra as a lever fulcrum, the tab 140 lifted in the inclined state is simultaneously supported by both the first rivet stub Ra and the second opening end 146. Accordingly, with reaction forces resulting from the support, the pressing portion 144 may more easily press the first opening portion 122.

The aforementioned opening processes may be summarized as follows. It can be understood that while the opening portions 122 and 124 are opened as the grip 142 of the tab 140 is lifted, the second opening portion 124 is first opened and the first opening portion is then opened. Further, since the second opening portion 124 is opened in the same manner as the ring-pull-tab type opening device, it is possible to easily open the second opening portion with a relatively smaller force. After the second opening portion 124 has been opened in such a way, the first opening portion 122 is subsequently opened.

At this time, since the second opening end 146 is supported by the top surface 110, it is possible for the pressing portion 144 to more easily press the first opening portion 122 by using the first rivet stub Ra as the lever fulcrum.

Further, since the first and second opening portions 122 and 124 are opened with the almost linear forces acting thereon as described above, it will be apparent that the opening portions 122 and 124 are more easily opened as a whole.

Figure 6:
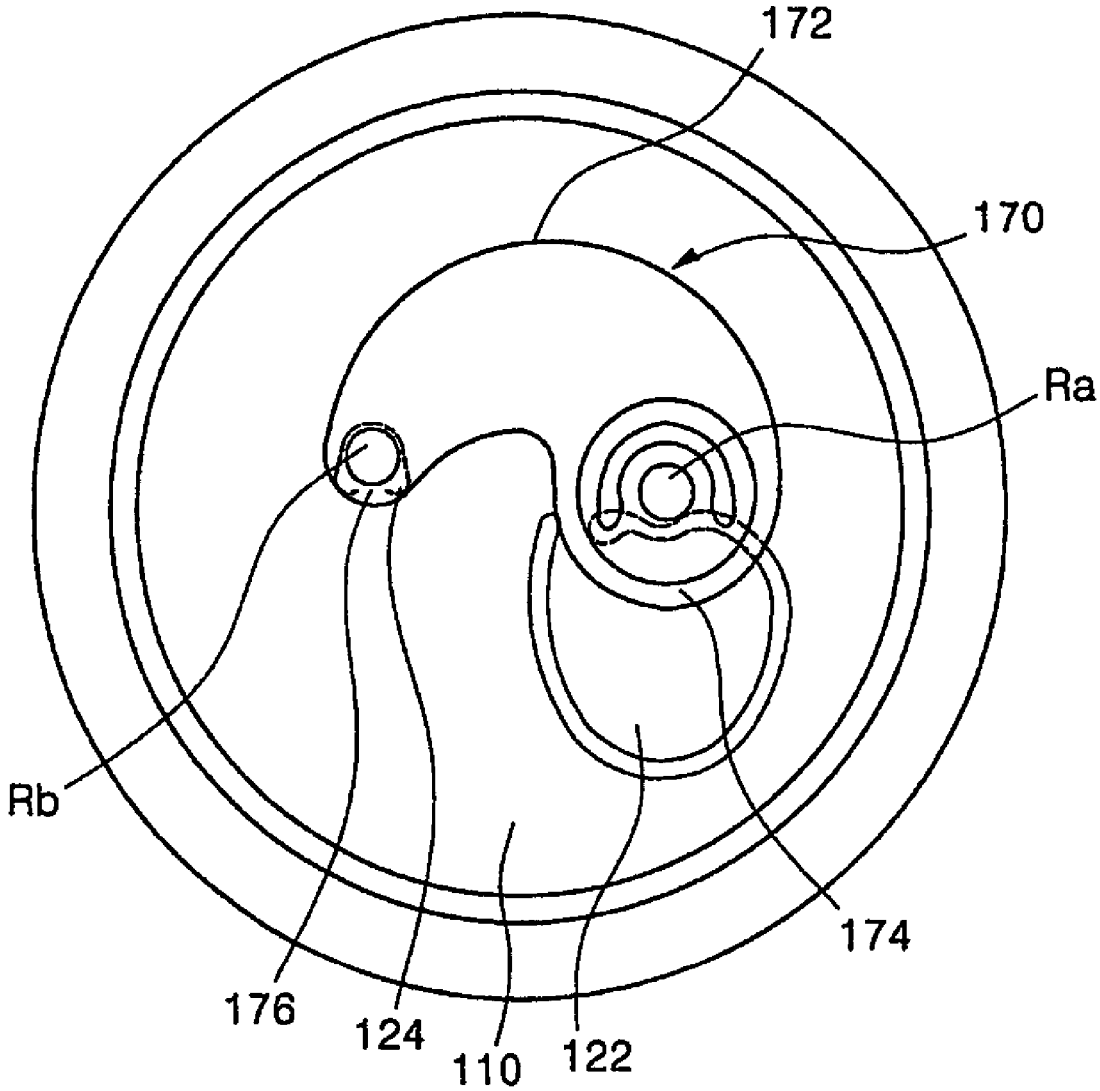
FIG. 6 is a plan view of a can according to another embodiment of the present invention.

Next, another embodiment of the present invention shown in FIG. 6 will be explained. In the description of this embodiment, the same elements as the previous embodiment will be designated by like reference numerals.

In an opening device according to the embodiment of the present invention, the pair of opening portions 122 and 124 is formed in the top surface 110 of the can and are opened by a single tab 170.

Other configurations except for the tab 170 in this embodiment are the same as the previous embodiment. The tab 170 in this embodiment is formed to take the shape of an arc, but the other configuration thereof is the same as the previous embodiment.

Even in this embodiment, when a grip 172 of the tab 170 is pulled up, the second opening portion 124 is opened while being lifted together with the second rivet stub Rb. When the second opening portion 124 is fully opened, a pressing portion 174 presses the first opening portion 122 by using the first rivet stub Ra as a lever fulcrum so that the first opening portion 122 may be opened.

The process of opening the second opening portion 124 is the same as the previous embodiment, and the support of a second opening end 176 by the top surface when the first rivet stub Ra serves as the lever fulcrum is also the same as the previous embodiment.

According to the present invention described above, it can be understood that the fundamental technical spirit of the present invention is to construct an opening device for a can such that the opening portions 122 and 124 may be opened in different fashions, respectively, to open them with a smallest force.

It will be apparent that those skilled in the art may make various modifications within the technical spirit and scope of the present invention, and that the invention should be construed only by the appended claims.

INDUSTRIAL APPLICABILITY

According to the present invention constructed as such, the following advantages are expected:

First, the opening device of the present invention comprises the first opening portion 122 through which the contents of the can flow out upon opening thereof, and the second opening portion 124 through which the exterior air is introduced into the can upon opening thereof while the contents flow out through the first opening portion. Therefore, since the contents flow out through the first opening portion 122 while the exterior air is introduced into the can through the second opening portion 124, the contents are able to very smoothly flow out from the can. In this regard, the present invention is deemed to be very useful when a user drinks beer or carbonated beverage.

Second, the opening portions 122 and 124 are opened sequentially and in different fashions, respectively. That is, the second opening portion that is first opened is opened while being lifted together with the rivet stub Ra, whereas the first opening portion is opened while being pressed by the pressing portion. Therefore, since the second opening portion is first opened more easily with a smaller force and the first opening portion is then opened, the two opening portions may be smoothly opened as a whole. Further, since the second opening end simultaneously serves as a lever fulcrum together with the rivet stub when the first opening portion is opened, the first opening portion may be more easily opened.

The invention claimed is:

1. An opening device for a can, which is formed on a top surface of a cylindrical can with contents contained therein, comprising:

a first opening portion through which the contents flow out upon opening thereof and a second opening portion through which exterior air is introduced into the can upon opening thereof, the first opening portion defined by a first incision line on the top surface and the second opening portion defined by a second incision line on the top surface so that a part of each of the opening portions is attached to the top surface; and a tab mounted on the top surface of the can by a first rivet stub installed outside of the first opening portion and a second rivet stub installed within the second opening portion, wherein a center of the first opening portion and the first rivet stub are substantially aligned forming a first line, and a center of the second opening portion and the second rivet stub are substantially aligned forming a second line substantially parallel to the first line, wherein a third line substantially perpendicular to the first line and the second line substantially bisects the top surface, and the first opening portion is located on an opposite side of the third line from the second opening portion, wherein the second opening portion is opened while being lifted together with the second rivet stub, the first opening portion is opened while being pressed by a pressing portion around the first rivet stub, and the second rivet stub is formed to be closer to a grip of the tab than the first rivet stub.

2. The device as claimed in claim 1, wherein a second opening end of the tab connected to the second rivet stub is formed to cover the second opening portion, and the tab is lifted while the second opening end comes into contact with and is then supported by the top surface when the first opening portion is opened through the first rivet stub by the pressing portion.

3. The device as claimed in claim 2, wherein the tab is "]"-shaped as a whole, so that the first and second rivet stubs allows linear forces to act on the opening portions when the grip is lifted.

4. An opening device for a can, which is formed on a top surface of a cylindrical can with contents contained therein, comprising:

a first opening portion through which the contents flow out upon opening thereof, the first opening portion being defined in the top surface of the can by a first incision line so that a part of the first opening portion is attached to the top surface;

a second opening portion through which exterior air is introduced into the can upon opening thereof when the contents flow out through the first opening portion, the second opening portion being formed to be relatively small by a second incision line so that a part of the second opening portion is attached to the top surface; and a tab mounted on the top surface of the can by means of a first rivet stub installed outside of the first opening portion and a second rivet stub installed within the second opening portion, wherein a center of the first opening portion and the first rivet stub are substantially aligned forming a first line, and a center of the second opening portion and the second rivet stub are substantially aligned forming a second line substantially parallel to the first line, wherein a third line substantially perpendicular to the first line and the second line substantially bisects the top surface, and the first opening portion is located on an opposite side of the third line from the second opening portion, wherein the second opening portion is opened while being lifted together with the second rivet stub, the first opening portion is opened while being pressed by a pressing portion around the first rivet stub, and the second rivet stub is formed to be closer to a grip of the tab than the first rivet stub.

* * * * *